US010170854B2

(12) United States Patent
Herbrechtsmeier et al.

(10) Patent No.: US 10,170,854 B2
(45) Date of Patent: Jan. 1, 2019

(54) HOLDING FRAME FOR PLUG CONNECTOR MODULES HAVING A LEAF-SPRING-TYPE FASTENING MEANS

(71) Applicant: HARTING Electric GmbH & Co. KG, Espelkamp (DE)

(72) Inventors: Heiko Herbrechtsmeier, Bünde (DE); Heiko Meier, Minden (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 15/754,550

(22) PCT Filed: Aug. 18, 2016

(86) PCT No.: PCT/DE2016/100372
§ 371 (c)(1),
(2) Date: Feb. 22, 2018

(87) PCT Pub. No.: WO2017/036449
PCT Pub. Date: Mar. 9, 2017

(65) Prior Publication Data

US 2018/0254576 A1 Sep. 6, 2018

(30) Foreign Application Priority Data

Sep. 3, 2015 (DE) ..... 10 2015 114 698

(51) Int. Cl.
*H01R 13/502* (2006.01)
*H01R 13/518* (2006.01)
(Continued)

(52) U.S. Cl.
CPC ..... *H01R 13/518* (2013.01); *H01R 13/506* (2013.01); *H01R 13/508* (2013.01); *H01R 13/512* (2013.01); *H01R 13/514* (2013.01)

(58) Field of Classification Search
CPC ..... H01R 13/514
(Continued)

(56) References Cited

U.S. PATENT DOCUMENTS 6,004,162 A 12/1999 Harting et al.
9,577,365 B1 * 2/2017 Herbrechtsmeier . H01R 13/518
2014/0179171 A1 * 6/2014 Mortun ..... H01R 25/142 439/701

FOREIGN PATENT DOCUMENTS

CN 201656162 U 11/2010
CN 204205152 U 3/2015
(Continued)

OTHER PUBLICATIONS

German Office Action, dated Aug. 10, 2016, for German Application No. 10 2015 114 698.3, 5 pages (no English translation provided).
(Continued)

*Primary Examiner* — Phuong Dinh
(74) *Attorney, Agent, or Firm* — Seed IP Law Group LLP

(57) ABSTRACT

The disclosure relates to a holding frame, into which plug connector modules can be inserted, wherein the holding frame comprises or consists of two halves articulated to each other, a first half and a second half, wherein the holding frame has at least one locking element, wherein the locking element is formed from a flat component, which overlaps the two halves at least in some regions, wherein the locking element has at least one end locking hook and wherein one half of the holding frame has at least one cut-out, in which the locking hook of the locking element can engage, whereby the holding frame can be fixed in an open position. The halves are fixed in relation to each other at an open angular position. Such a holding frame can be conveniently fixed in an open position for fitting with suitable plug connector modules.

10 Claims, 3 Drawing Sheets

(51) Int. Cl.
*H01R 13/506* (2006.01)
*H01R 13/508* (2006.01)
*H01R 13/512* (2006.01)
*H01R 13/514* (2006.01)

(58) Field of Classification Search
USPC ..... 439/701, 540.1
See application file for complete search history.

(56) References Cited

FOREIGN PATENT DOCUMENTS

| | | |
|---|---|---|
| CN | 204271392 U | 4/2015 |
| DE | 197 07 120 C1 | 6/1998 |
| DE | 20 2012 103 360 U1 | 3/2013 |

OTHER PUBLICATIONS

International Search Report and Written Opinion, dated Nov. 4, 2016, for International Application No. PCT/DE2016/100372, 10 pages (with English translation of Search Report).

* cited by examiner

HOLDING FRAME FOR PLUG CONNECTOR MODULES HAVING A LEAF-SPRING-TYPE FASTENING MEANS

BACKGROUND

Technical Field

The disclosure relates to a holding frame for plug connector modules.

Holding frames of this type serve for holding plug connector modules, wherein the holding frame is equipped with different plug connector modules and then inserted into a plug connector housing and screwed thereto. The holding frame here has to be mechanically stable to enable it to withstand the insertion and withdrawal forces which arise during the respective joining and separation of the plug connection.

Description of the Related Art

A holding frame for plug connector modules is disclosed in DE 197 07 120 C1. The holding frame comprises two halves which are connected to one another via a joint. Latching hooks of the plug connector modules engage in cut-outs in the lateral surfaces of the respective halves. The joint or the end joints are arranged in the fastening ends of the holding frame. When the holding frame is screwed to a fastening surface, the frame parts are aligned such that the lateral parts of the holding frame are aligned at a right angle to the fastening surface. The plug connector modules are thus secured in the holding frame.

The holding frame in DE 197 07 120 C1 does not have a clearly defined open position for equipping the holding frame with plug connector modules. This sometimes results in somewhat awkward assembly, in particular for inexperienced users.

To successfully equip the holding frame with plug connector modules, it has to be brought into a closed state or into a closed position so that the plug connector modules are secured. There is no secured closed state for the closed state of the holding frame of the prior art, which means that the holding frame can inadvertently open, thereby enabling the modules to fall out of their anchorage.

Using a purely jointed connection, there is not always a defined electrical contact between the halves of the holding frame. It is therefore not possible to ensure reliable use of the holding frame for grounding purposes.

CN 204 205 152 U discloses a holding frame which comprises two halves which are connected to one another in a jointed manner. To equip the holding frame with plug connector modules, the halves can be brought into an open angled position. This has to work against the force of a spring. The restoring force of the spring draws the halves 1, 2 back into a closed position again after the equipping procedure.

CN 201 656 162 U discloses a holding frame which comprises two halves which are connected to one another linearly via a spring. To equip the holding frame with plug connector modules, the halves can be drawn linearly into an open position. This has to work against the force of a spring. The restoring force of the spring draws the halves back into a closed position again after the equipping procedure.

Working against the spring makes the equipping process of the holding frame difficult since, on the one hand, the halves have to be secured manually and the plug connector modules have to be inserted at the same time.

DE 20 2012 103 360 U1 discloses a holding frame which comprises two halves, which can be latched to one another in two different latching positions as a result of a linear displacement of one frame half relative to the other frame half. However, the plug connector modules can fall through a linearly opened holding frame during the equipping procedure.

BRIEF SUMMARY

Embodiments of the present invention provide a holding frame which is easy to handle and versatile.

The holding frame according to an embodiment of the present invention is provided to be filled with plug connector modules and incorporated in a plug connector housing or a machine wall and screwed thereto. The holding frame comprises two halves which can be connected to one another, a first half and a second half, which form a mutual separating plane which extends parallel to longitudinal sides of the halves.

The holding frame has a locking element having at least one latching hook at an end thereof. At least one cut-out, in which the latching hook of the locking element is engageable or can engage, is incorporated in one half of the holding frame. The cut-out is selected such that the two halves are at an angled position of less than 180° with respect to one another when the locking element is engaged. The angled position is explained in more detail further below. The holding frame is thus secured in an open position.

The holding frame has at least one locking element and the halves can be mutually aligned and secured via the first locking element in at least two positions, an open position and a closed position. The alignability is achieved by the jointed connection of the two halves of the holding frame. The securability is achieved by the locking element. The holding frame is particularly user-friendly as a result of the interaction between the jointed connection and the securability in two positions.

The holding frame can optionally be selectively secured in an open position or in a closed position.

The halves of the holding frame each lie in a plane, in the interface of which an angle $\alpha$ is formed. Open position means that the halves are at an angle $\alpha$ other than 180° with respect to one another along the separating line. The angle is preferably between 130° and 170°. An angle between 155° and 165° has proven particularly advantageous. In this angled position of the halves, the plug connector modules can be inserted particularly easily into the holding frame. In the closed position, the halves assume an angle of approximately 180° or precisely 180° with respect to one another. The halves are therefore parallel to one another in the closed position.

In an advantageous embodiment of the invention, the locking element is formed from a flat component which covers both halves of the holding frame, at least in some regions. The locking element is arranged at one end of the holding frame. The other end of the holding frame is constructed without a locking element, which gives the holding frame a particularly economical design and makes it easy to handle. The locking element is secured to one half of the holding frame, for example via a screw.

The locking element advantageously has a first finger and a second finger. The first and second fingers lie within the same plane. The first finger is designed to be longer than the second finger and a latching hook is integrally formed on the end of the second finger. This construction can be produced very simply and economically, for example in a stamping and bending technique.

One half of the holding frame preferably has a cut-out into which the latching hook of the second finger of the locking element can engage. The holding frame can thus be secured in an open position. The second finger holds the frame half in place so that it cannot fall back into the closed position. In terms of the production technology, a cut-out described above can be easily realized in the holding frame or in one half of the holding frame.

It is particularly advantageous if the second finger of the locking element or the locking element itself consists of an elastic material. As a result of a movement of the second finger in a direction away from the holding frame, the second finger can be removed from the cut-out and the holding frame can thus be brought into a closed position. The latching hook can thus be pried out of the cut-out by the movement described above. The solution is very user-friendly.

In an advantageous embodiment of the invention, the first finger exerts a force on the second half of the holding frame, whereby the holding frame can be secured in the closed position. The force is directed in opposition to the rotational movement of the joint axis of the two halves. The second half can be secured in an angled position with respect to the first half, in opposition to the force effect of the first spring, by the second finger, whereby the holding frame can be secured in the open position.

The halves preferably consist of a metallic material and are in electrically conductive contact with one another. The electrical contact can preferably be produced via the locking element.

In the present disclosure, the terms open or closed state and open or closed position are used synonymously.

The two halves are reliably brought into electrical contact with one another via the locking element. On the one hand, this takes place via the locking element itself so long as it is manufactured from an electrically conductive material. Moreover, as a result of the pre-tension of the locking element, the joint head of one half is pressed into the joint receiving means of the other half, whereby reliable electrical contact is produced.

BRIEF DESCRIPTION OF THE SEVERAL VIEWS OF THE DRAWINGS

An exemplary embodiment of the invention is illustrated in the drawings and will be explained in more detail below. The drawings are as follows.

The figures contain partially simplified schematic illustrations. Identical reference numerals are sometimes used for elements which are similar but possibly not identical. Different views of similar elements could be drawn to different scales.

DETAILED DESCRIPTION

Figure 1:
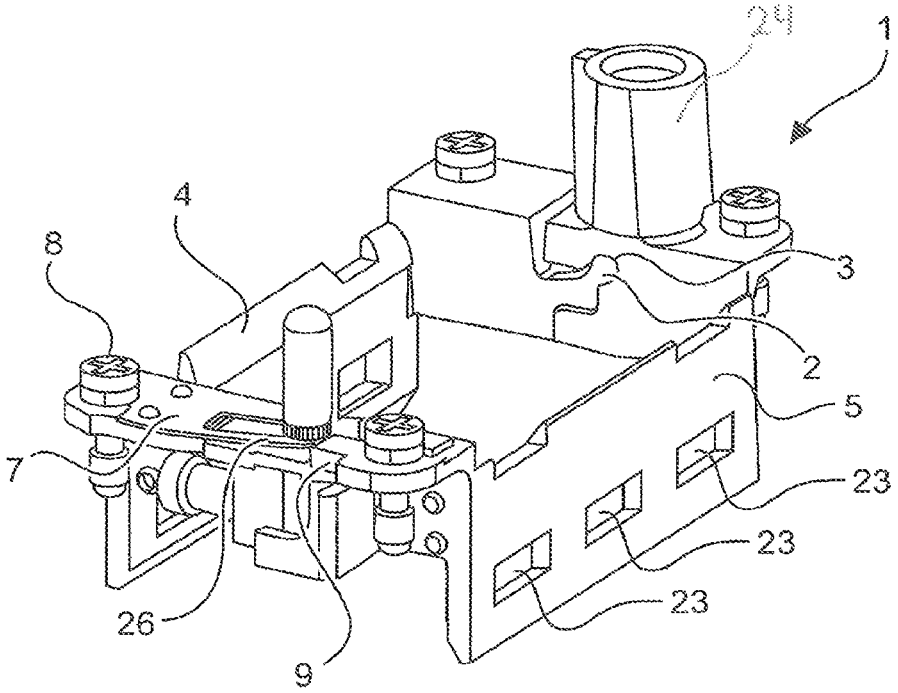
FIG. 1 shows a perspective illustration of a holding frame having a locking element in a closed position.

FIG. 1 shows the perspective illustration of a holding frame 1 which is in a closed position. The holding frame substantially comprises two halves 4, 5, which are connected to one another via a joint. To this end, one half 5 has a joint head 2 on the respective end faces, which joint head 2 engages in a joint receiving means 3 provided for this purpose in the opposite half 4. This refers to a jointed connection of the two halves 4, 5 of the holding frame 1.

The holding frame 1 has a grounding socket 24 in which a pin (not shown) of an opposite holding frame (not shown) can engage.

Figure 2:
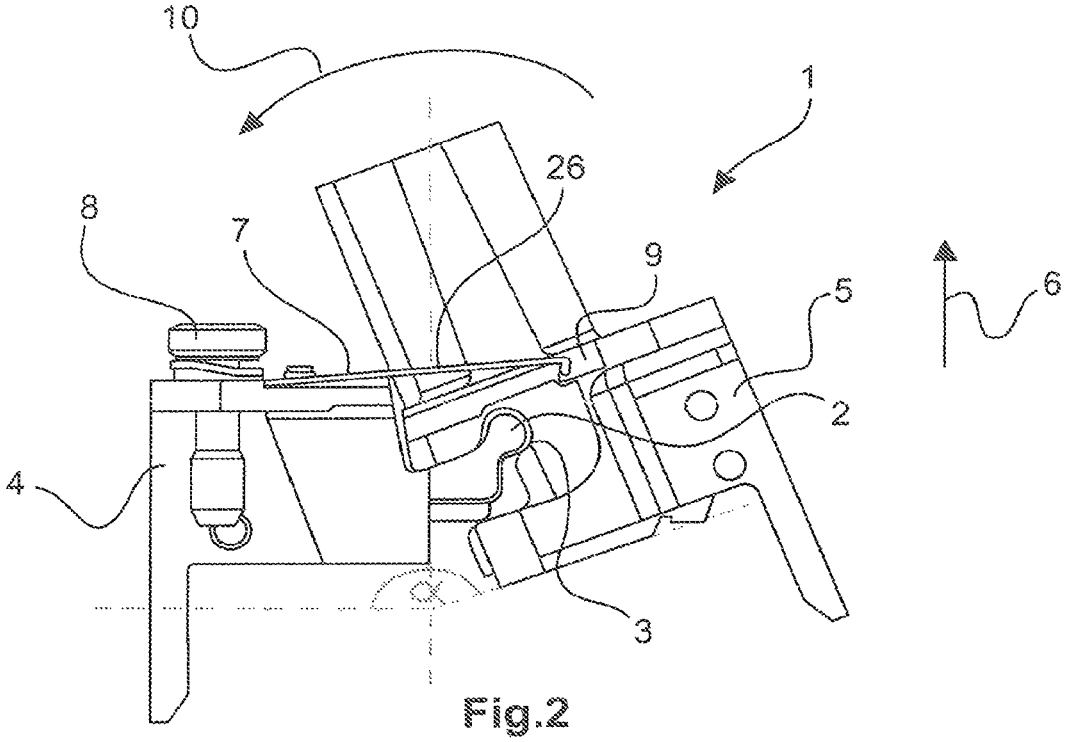
FIG. 2 shows a plan view of an end face of the holding frame having a locking element in an open position.
Figure 3:
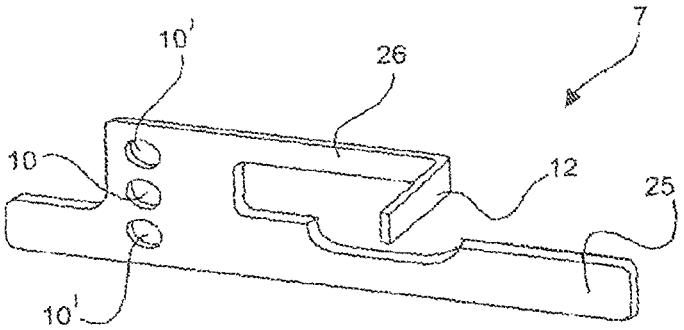
FIG. 3 shows a perspective illustration of a locking element.
Figure 4:
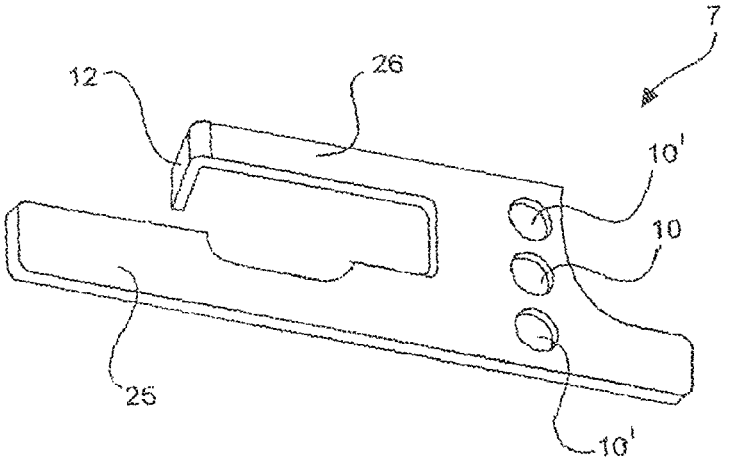
FIG. 4 shows a further perspective illustration of a locking element.

The holding frame 1 can be seen in an open position in FIG. 2. In this open position, the holding frame 1 is secured via the locking element 7. The locking element 7 is substantially designed as a flat component having a first finger 25 and a second finger 26, wherein the second finger 26 is shorter than the first finger 25. A latching hook 12 is located at the end of the second finger 26. Opposite the fingers 25, 26, the locking element 7 has openings 10, 10' via which the locking element 7 is secured to one half 4 of the holding frame 1 with the aid of a screw 8.

Figure 5:
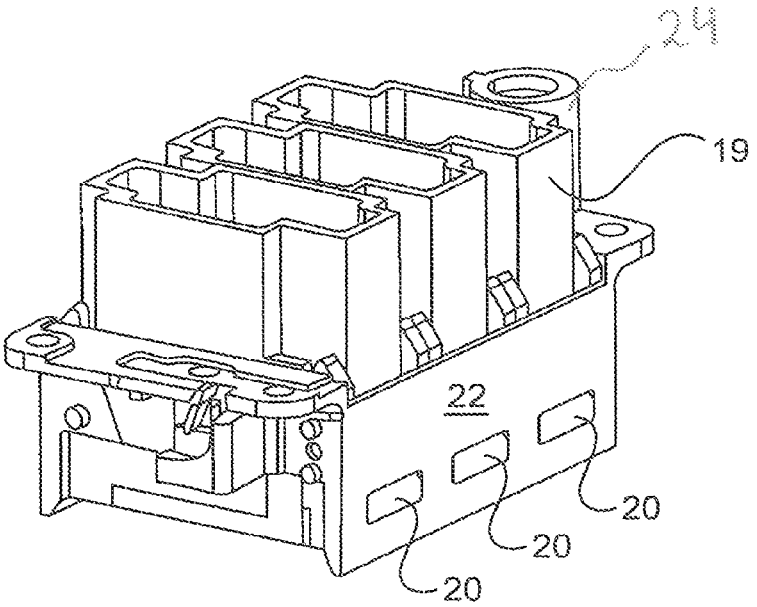
FIG. 5 shows a perspective illustration of a holding frame equipped with plug connector modules.
Figure 6:
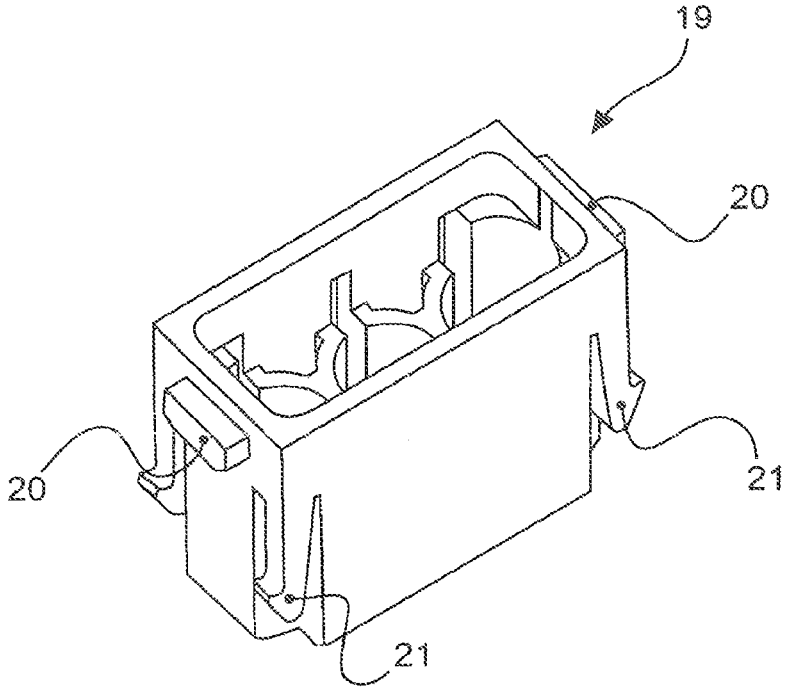
FIG. 6 shows a perspective illustration of a plug connector module.

One half 5 of the holding frame 1 has a cut-out 9 in which—in the open position of the holding frame 1—the latching hook 12 of the second finger 26 of the locking element 7 engages. The locking element 7 holds the holding frame 1 securely in this position so that the holding frame 1 can be easily equipped with plug connector modules 19 (FIGS. 5 and 6).

If the second finger 26 is drawn away from the holding frame 1 in the direction of the arrow 6 shown in FIG. 2, the latching hook 12 is released from an undercut in the cut-out 9. The halves 4, 5 can now be moved towards one another via the jointed connection, whereby the holding frame 1 assumes a closed position. The latching hook 12 of the second finger 26 now lies on the holding frame 1. The fingers 25, 26 exert a force on the half 5 in the closed position of the holding frame 1, which force acts in the opposite direction to the arrow 6. The holding frame 1 is thus secured in the closed position. The plug connector modules 19 can no longer simply fall out when the holding frame 1 equipped with plug connector modules 19 is lifted and incorporated in a plug connector housing (not shown).

If the halves 4, 5 of the holding frame 1 are moved along the curved arrow 10 shown in FIG. 2 towards one another, the latching hook 12 is automatically guided into the cut-out 9 as a result of this movement and latches there against the said undercut. The holding frame 1 is thus secured in the open position.

Plug connector modules 19 have been known for a long time and are described for example in DE 197 07 120 C1. The plug connector modules 19 are provided with protruding, approximately rectangular holding means 20 and resilient latching hooks 21. Formed in the lateral parts 22 of the halves 4, 5 are fully enclosed openings 23 into which the holding means 20 dip when the plug connector modules 19 are inserted into the holding frame 1.

To insert the plug connector modules 19, the holding frame 1 is brought into an open position as described above so that the plug connector modules 19 can be inserted. To pre-secure the plug connector modules 19, the latching hooks 21 firstly reach below the lower edges of the lateral parts 22 of the halves 4, 5 during the insertion procedure.

The frame halves 4, 5 are then brought into a closed position as described above, wherein the holding means 20 arrive in the openings 23 and a reliable form-fitting holding of the plug connector modules 19 in the holding frame 1 is effected.

To reiterate, embodiments of the invention relate to a holding frame 1 into which plug connector modules 19 can be inserted, wherein the holding frame 1 comprises two halves 4, 5 connected to one another in a jointed manner, a first half 4 and a second half 5, wherein the holding frame 1 has at least one locking element 7, wherein the locking element 7 is formed from a flat component which covers both halves 4, 5, at least in some regions, wherein the locking element 7 has at least one latching hook 12 at an end thereof and wherein one half 5 of the holding frame 1 has at least one cut-out 9 in which the latching hook 12 of the locking element 7 can engage, whereby the holding frame 1 can be secured in an open position. The halves are secured in an open angled position with respect to one another. Such a holding frame can be conveniently secured in an open position to be equipped with suitable plug connector modules.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A holding frame into which plug connector modules can be inserted, wherein the holding frame comprises:

two halves which can be connected to one another in a jointed manner, a first half and a second half; and at least one locking element formed from a flat component which covers both halves at least in some regions, the locking element having at least one latching hook at an end thereof, and wherein one half of the holding frame has at least one cut-out in which the latching hook of the locking element can engage, whereby the holding frame can be secured in an open position.

2. The holding frame as claimed in claim 1, wherein the holding frame has a separating plane which extends parallel to longitudinal sides of the halves.

3. The holding frame as claimed in claim 1, wherein the locking element is secured to one of the halves.

4. The holding frame as claimed in claim 3, wherein the locking element has a first finger and a second finger.

5. The holding frame as claimed in claim 4, wherein the first finger is longer than the second finger.

6. The holding frame as claimed in claim 4, wherein the latching hook is integrally formed on an end of the second finger.

7. The holding frame as claimed in claim 4, wherein the first and second fingers project from one half of the holding frame to the other half.

8. The holding frame as claimed in claim 4, wherein the locking element consists of an elastic material, and wherein, as a result of a movement of the second finger in a direction away from the holding frame, the second finger can be removed from the cut-out and the holding frame can thus be brought into a closed position.

9. The holding frame as claimed in claim 4, wherein the first finger exerts a force on the second half, whereby the holding frame can be secured in the closed position, and wherein the second half can be secured in an angled position with respect to the first half, in opposition to the force effect of the first finger, by the second finger, whereby the holding frame can be secured in the open position.

10. The holding frame as claimed in claim 1, wherein the halves consist of a metallic material and are in electrically conductive contact with one another.

* * * * *